US010450988B2

(12) United States Patent
Tomomatsu

(10) Patent No.: US 10,450,988 B2
(45) Date of Patent: Oct. 22, 2019

(54) ENGINE CONTROL DEVICE AND ENGINE CONTROL METHOD

(71) Applicant: Mitsubishi Electric Corporation, Tokyo (JP)

(72) Inventor: Nobuyoshi Tomomatsu, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 267 days.

(21) Appl. No.: 15/343,269

(22) Filed: Nov. 4, 2016

(65) Prior Publication Data

US 2017/0314497 A1 Nov. 2, 2017

(30) Foreign Application Priority Data

May 2, 2016 (JP) ..... 2016-092431

(51) Int. Cl.
*F02D 41/10* (2006.01)
*F02D 41/30* (2006.01)
(Continued)

(52) U.S. Cl.
CPC ..... *F02D 41/3005* (2013.01); *F02D 41/0097* (2013.01); *F02D 41/10* (2013.01);
(Continued)

(58) Field of Classification Search
CPC .. F02D 41/3005; F02D 41/1458; F02D 41/10; F02D 41/0097; F02D 41/045;
(Continued)

(56) References Cited

U.S. PATENT DOCUMENTS 4,010,717 A * 3/1977 Taplin ..... F02D 41/107 123/488
6,814,050 B2 * 11/2004 Kishibata ..... F02D 41/123 123/198 DB (Continued)

FOREIGN PATENT DOCUMENTS

JP 2002147269 A 5/2002
JP 2008-128119 A 6/2008
JP 4239578 B2 3/2009

OTHER PUBLICATIONS

Communication dated Apr. 29, 2019 from the patent office of the Intellectual Property India in application No. 201644039342.

*Primary Examiner* — David Hamaoui
(74) *Attorney, Agent, or Firm* — Sughure Mion, PLC; Richard C. Turner

(57) ABSTRACT

A fuel injection control unit includes: a first transience determination unit which determines an accelerating state when the first intake pressure differential integration value in a section including a compression stroke, an expansion stroke and an exhaust stroke is greater than a first acceleration determination threshold value; a first transient fuel injection amount calculation unit which calculates an additional fuel injection amount on the basis of the first intake pressure differential integration value; a second transience determination unit which determines an accelerating state when the second intake pressure differential integration value in a section including an intake stroke is greater than a second acceleration determination threshold value which is smaller than the first acceleration determination threshold value; and a second transient fuel injection amount calculation unit which calculates an additional fuel injection amount on the basis of the second intake pressure differential integration value.

9 Claims, 8 Drawing Sheets

(51) Int. Cl.

| | |
|---|---|
| ***F02M 35/10*** | (2006.01) |
| ***F02D 41/00*** | (2006.01) |
| ***F02D 41/14*** | (2006.01) |
| *F02D 41/04* | (2006.01) |

(52) U.S. Cl.
CPC ..... *F02D 41/1458* (2013.01); *F02M 35/1038* (2013.01); *F02M 35/10255* (2013.01); *F02D 41/045* (2013.01); *F02D 2200/0406* (2013.01); *F02D 2200/1002* (2013.01)

(58) Field of Classification Search
CPC .... F02D 2200/0406; F02D 2200/1002; F02M 35/10255; F02M 35/1038
See application file for complete search history.

(56) References Cited

U.S. PATENT DOCUMENTS

| | | | | |
|---|---|---|---|---|
| 6,934,623 | B2 * | 8/2005 | Nakamura | F02D 41/045 123/492 |
| 6,997,167 | B2 * | 2/2006 | Kitagawa | F02D 41/045 123/480 |
| 7,185,637 | B1 * | 3/2007 | Yanagisawa | F02D 41/045 123/492 |

* cited by examiner

ENGINE CONTROL DEVICE AND ENGINE CONTROL METHOD

BACKGROUND OF THE INVENTION

1. Field of the Invention

The invention relates to an engine control device and an engine control method for controlling a fuel injection amount in accordance with the operational state of an engine.

2. Description of the Related Art

Conventionally, an operational state determination device is known which determines whether the operation of an engine is in a transient state of accelerating or decelerating, or in a steady state, on the basis of change in the intake pressure (see, for example, Japanese Patent Application Publication No. 2008-128119).

This operational state determination device calculates an integration value which sums the intake pressure for one past period from the current intake pressure, and an integration value which sums the intake pressure for one past period from a previous intake pressure, and determines that an engine is in an accelerating transient state if the differential between the integration values is greater than a prescribed acceleration threshold value, determines that the engine is in a decelerating transient state if the differential is smaller than a prescribed deceleration threshold value, and determines that the engine is in a steady state if the differential is equal to or greater than the deceleration threshold value and equal to or lower than the acceleration threshold value.

According to this operational state determination device, it is possible to determine whether an engine is in a transient state or a steady state, simply by comparing an integration value which sums the intake pressure for one past period from the current intake pressure, and an integration value which sums the intake pressure for one past period from a previous intake pressure. Therefore, it is possible to reduce the processing load of the device.

SUMMARY OF THE INVENTION

In the operational state determination device disclosed in Japanese Patent Application Publication No. 2008-128119, the amount of change in the intake pressure is calculated by universally integrating the intake pressure obtained at all crank angle intervals. In this case, if the accelerator opening changes during the compression stroke, the expansion stroke or the exhaust stroke, in the combustion cycle of the engine, then since the change in the accelerator opening has a significant effect on the amount of change in the intake pressure, there is a margin for an accelerating state to be determined from the differential between the integration values, and for an additional fuel injection to be performed in preparation for the increase in the intake air amount in the next intake stroke.

On the other hand, if the accelerator opening changes during the intake stroke in the combustion cycle of the engine, then it is necessary for the accelerating state to be determined immediately, and for an additional fuel injection to be performed before the intake value closes, in preparation for the increased intake air volume during the intake stroke in question. However, due to the delay in the response of the intake pressure sensor, it takes time for the change in the accelerator opening to affect the amount of change in the intake pressure, and therefore, it is necessary to determine the accelerating state on the basis of a very small change in the intake pressure, compared to the compression stroke, the expansion stroke or the exhaust stroke.

In this respect, in the operational state determination device disclosed in Japanese Patent Application Publication No. 2008-128119, when the acceleration threshold value is set in accordance with a very small change in the intake pressure in the intake stroke, the accelerating state is determined with excessive sensitivity in relation to the change in the intake pressure during the other strokes, and if the acceleration threshold value is set in accordance with the change in the intake pressure during the other strokes, then it becomes impossible to determine an accelerating state in relation to a very small change in the intake pressure during the intake stroke. Consequently, there is a problem in that the air/fuel ratio of the engine cannot be controlled accurately in relation to change in the accelerator opening.

The invention was devised in order to resolve the problem described above, an object thereof being to obtain an engine control device and engine control method whereby the air/fuel ratio can be controlled with high accuracy, even when the accelerator opening changes at any timing during the combustion cycle of the engine.

The integrated engine control device according to the invention includes: a throttle valve provided in an intake pipe of an engine; an intake pressure sensor which detects an intake pressure inside the intake pipe on a downstream side of the throttle valve; a crank angle sensor which detects a crank angle of a crankshaft of the engine; and a fuel injection control unit which controls an amount of fuel injected to a cylinder of the engine, on the basis of the intake pressure detected by the intake pressure sensor, wherein the fuel injection control unit includes: a first transience determination unit which calculates, as a first intake pressure differential integration value, an integrated value of an amount of change in the intake pressure in a first section that includes a compression stroke, an expansion stroke and an exhaust stroke, of a combustion cycle of the engine, and which determines an accelerating state of the engine when the first intake pressure differential integration value is greater than a first acceleration determination threshold value; a first transient fuel injection amount calculation unit which calculates an additional fuel injection amount on the basis of the first intake pressure differential integration value; a second transience determination unit which calculates, as a second intake pressure differential integration value, an integrated value of an amount of change in the intake pressure in a second section that includes an intake stroke, of the combustion cycle of the engine, and which determines an accelerating state of the engine when the second intake pressure differential integration value is greater than a second acceleration determination threshold value which is smaller than the first acceleration determination threshold value; and a second transient fuel injection amount calculation unit which calculates an additional fuel injection amount on the basis of the second intake pressure differential integration value.

The engine control method according to the invention is an engine control method performed in an engine control device that includes: a throttle valve provided in an intake pipe of an engine; an intake pressure sensor which detects an intake pressure inside the intake pipe on a downstream side of the throttle valve; a crank angle sensor which detects a crank angle of a crankshaft of the engine; and a fuel injection control unit which controls an amount of fuel injected to a cylinder of the engine, on the basis of the intake pressure detected by the intake pressure sensor, the method including: a first transience determination step of calculating, as a first intake pressure differential integration value, an integrated value of an amount of change in the intake pressure in a first section that includes a compression stroke, an expansion stroke and an exhaust stroke, of a combustion cycle of the engine, and determining an accelerating state of the engine when the first intake pressure differential integration value is greater than a first acceleration determination threshold value; a first transient fuel injection amount calculation step of calculating an additional fuel injection amount on the basis of the first intake pressure differential integration value; a second transience determination step of calculating, as a second intake pressure differential integration value, an integrated value of an amount of change in the intake pressure in a second section that includes an intake stroke, of the combustion cycle of the engine, and determining an accelerating state of the engine when the second intake pressure differential integration value is greater than a second acceleration determination threshold value which is smaller than the first acceleration determination threshold value; and a second transient fuel injection amount calculation step of calculating an additional fuel injection amount on the basis of the second intake pressure differential integration value.

According to the engine control device and the engine control method of the invention, if a first intake pressure differential integration value is greater than a first acceleration determination threshold value during a first section which includes a compression stroke, an expansion stroke and an exhaust stroke, of a combustion cycle of an engine, then an accelerating state of the engine is determined and an additional fuel injection amount is calculated, and if a second intake pressure differential integration value is greater than a second acceleration determination threshold value, which is smaller than the first acceleration determination threshold value, during a second section which includes an intake stroke of the combustion cycle of the engine, then an accelerating state of the engine is determined and an additional fuel injection amount is calculated.

Therefore, it is possible to control the air/fuel ratio with high accuracy, even when the accelerator opening changes at any timing during the combustion cycle of the engine.

DESCRIPTION OF THE PREFERRED EMBODIMENT

Figure 1:
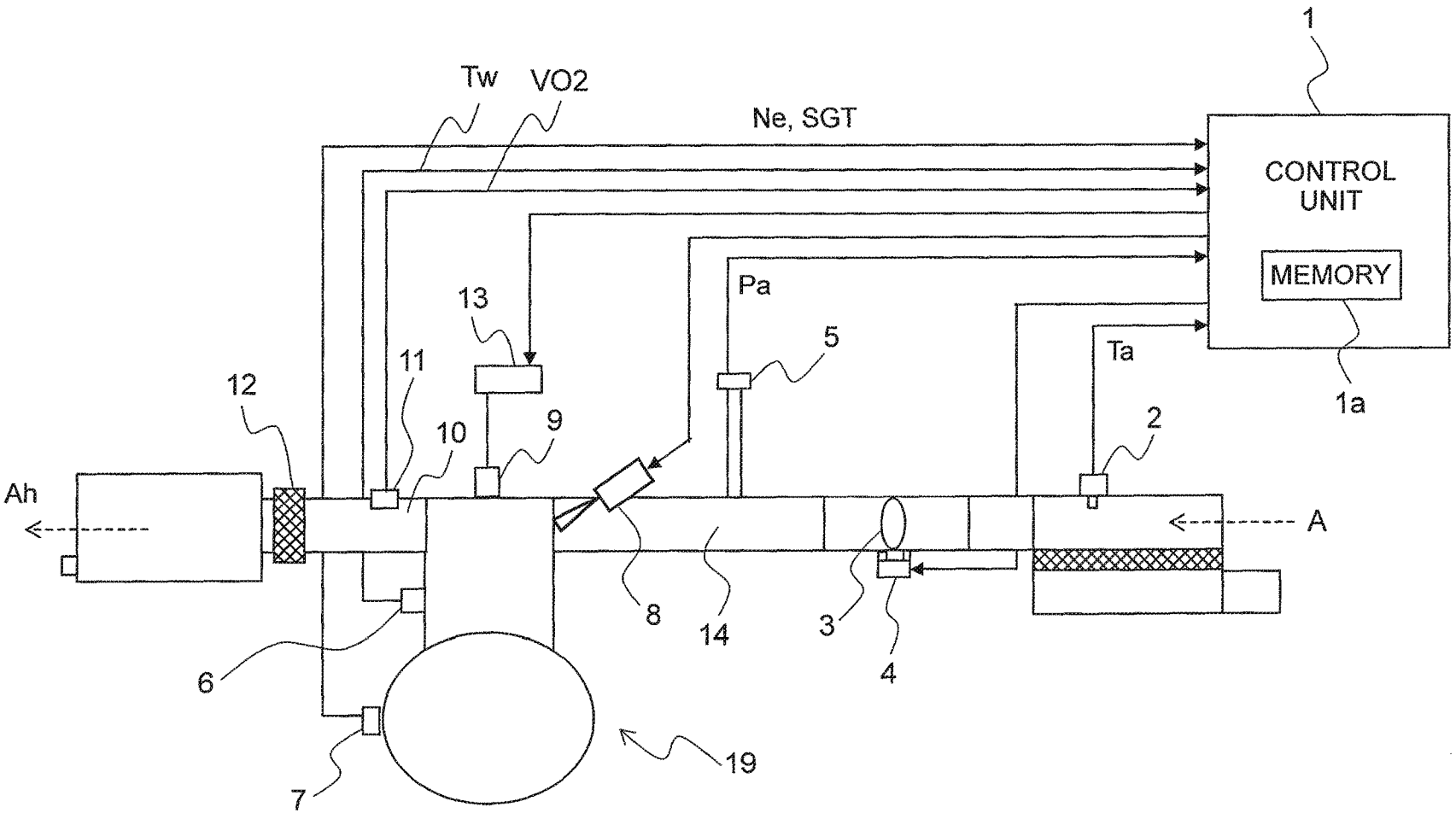
FIG. 1 is a schematic drawing showing an engine to which an engine control device according to a first embodiment of the invention is applied.

Below, a preferred embodiment of the engine control device and engine control method according to the invention is described with reference to the drawings, and parts which are the same or corresponding are labelled with the same reference numerals in the drawings.

First Embodiment

FIG. 1 is a schematic drawing showing an engine to which an engine control device according to a first embodiment of the invention is applied. In FIG. 1, a control unit 1 is the main portion of the engine control device.

The control unit 1 is configured by a microcomputer including a central processing unit (CPU), which is not illustrated, and a memory 1*a*. The control unit 1 stores programs and maps for controlling the overall operation of an engine 19, in the memory 1*a*.

The engine 19 is provided with an intake pipe 14 and an exhaust pipe 10. The intake pipe 14 introduces intake air A into the engine 19. Furthermore, the exhaust pipe 10 expels exhaust gas Ah from the engine 19.

An intake air temperature sensor 2, a throttle valve 3, an intake pressure sensor 5 and a fuel injection module 8 are provided in the intake pipe 14. The intake air temperature sensor 2 detects the temperature of the intake air A introduced into the intake air pipe 14, as an intake air temperature Ta. The throttle valve 3 is driven to open and close by a throttle actuator 4, and thereby adjusts the intake air volume of the intake air A. The intake pressure sensor 5 detects an intake pressure Pa in the intake pipe, on the downstream side of the throttle valve 3. The fuel injection module 8 includes an injector which injects fuel into the engine 19.

An engine temperature sensor 6, crank angle sensor 7 and spark plug 9 are provided in the engine 19. The engine temperature sensor 6 detects the wall surface temperature of the engine 19, as an engine temperature Tw. The crank angle sensor 7 outputs an engine rotation speed Ne, and a pulse-shaped crank angle signal SGT corresponding to the crank position. The spark plug 9 is driven by an ignition coil 13.

An oxygen sensor 11 and a three-way catalytic converter 12 are provided in the exhaust pipe 10. The oxygen sensor 11 outputs a voltage value VO2 corresponding to the oxygen concentration in the exhaust gas Ah. The three-way catalytic converter 12 cleans the exhaust gas Ah. The control unit 1 refers to the voltage value VO2 output from the oxygen sensor 11, and controls the fuel injection amount in such a manner that the air/fuel ratio becomes a theoretical air/fuel ratio at which the exhaust gas cleaning rate of the three-way catalytic converter 12 is high.

In this engine 19, the installation of a throttle sensor for detecting the angle of the throttle valve 3 is abandoned. By determining the operational state of the engine 19 without using a throttle sensor, costs can be reduced by omitting the throttle sensor. Furthermore, the engine control device according to this first embodiment is also established in a system which is not provided with sensors such as the intake air temperature sensor 2 or the engine temperature sensor 6.

Figure 2:
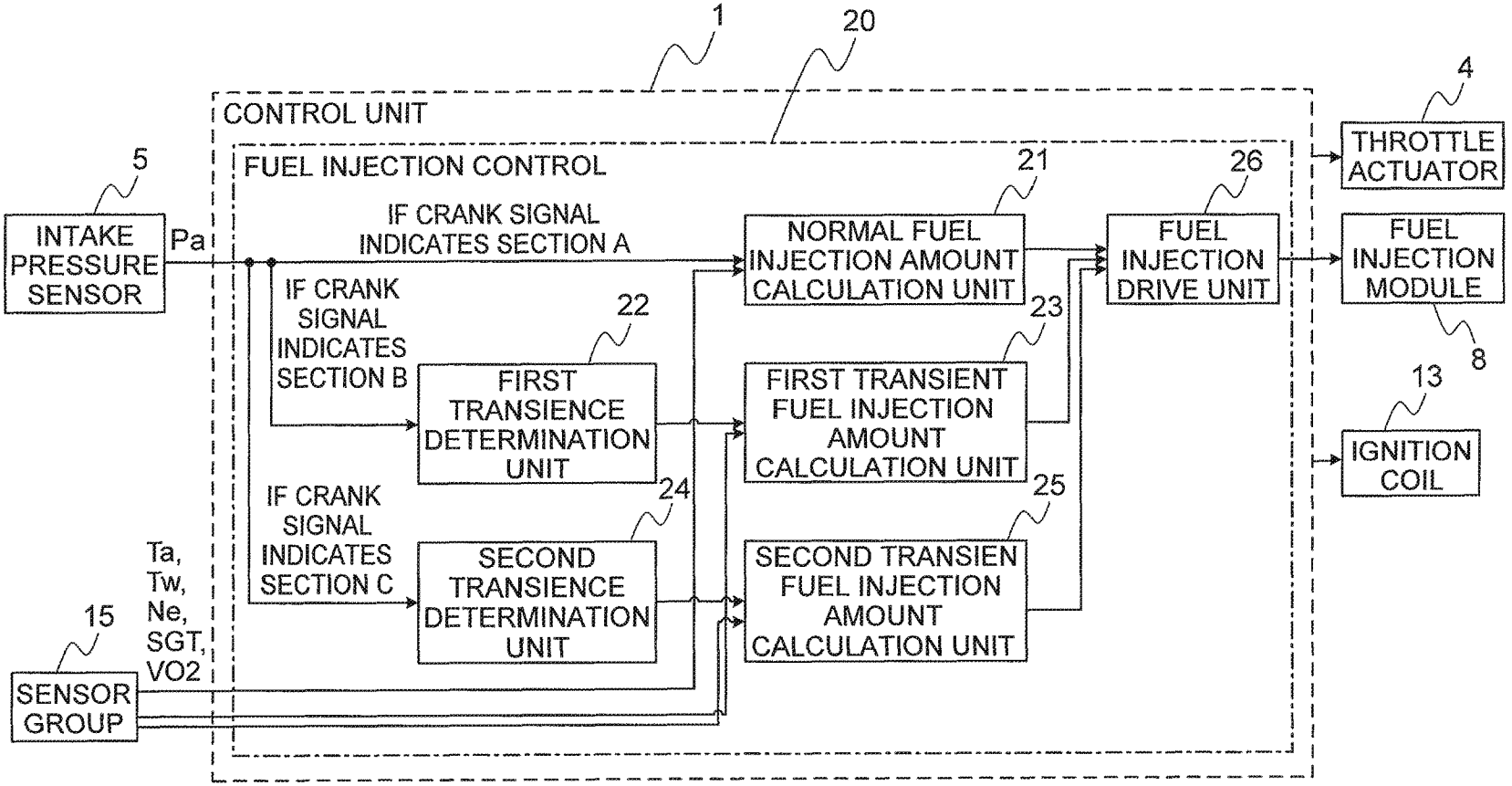
FIG. 2 is a schematic block drawing showing the engine control device according to the first embodiment of the invention.

FIG. 2 is a schematic block drawing showing the engine control device according to the first embodiment of the invention. In FIG. 2, the control unit 1 receives an input of operational state information from the intake pressure sensor 5 and a sensor group 15, and outputs a drive command to the throttle actuator 4, the fuel injection module 8 and the ignition coil 13.

The sensor group 15 includes the intake air temperature sensor 2, the engine temperature sensor 6, the crank angle sensor 7 and the oxygen sensor 11 illustrated in FIG. 1, and the operational state information received from the sensor group 15 includes at least one of the intake air temperature Ta, the engine temperature Tw, the engine rotation speed Ne, the crank angle signal SGT and the voltage value VO2. These elements of operational state information are input to the control unit 1. Furthermore, the intake pressure Pa from the intake pressure sensor 5 is input to the control unit 1 as operational state information.

The control unit 1 has a fuel injection control unit 20, in addition to an ignition timing control unit (not illustrated) which controls the ignition timing. The ignition timing control unit is not a principal part of the invention and concrete description thereof is omitted here. The fuel injection control unit 20 controls the amount of the fuel injected to the cylinders of the engine 19, on the basis of the operational state information from the intake pressure sensor 5 and the sensor group 15.

The fuel injection control unit 20 includes a normal fuel injection amount calculation unit 21, a first transience determination unit 22, a first transient fuel injection amount calculation unit 23, a second transience determination unit 24, a second transient fuel injection amount calculation unit 25 and a fuel injection drive unit 26.

The normal fuel injection amount calculation unit 21 estimates the amount of air taken into the cylinder of the engine 19, and calculates a fuel injection amount suited to the amount of air, on the basis of the operational state information from the intake pressure sensor 5 and the sensor group 15. Here, it is known that there is a correlation between the amount of air taken into the cylinder of the engine 19, and the intake pressure Pa and engine rotation speed Ne.

Figure 3:
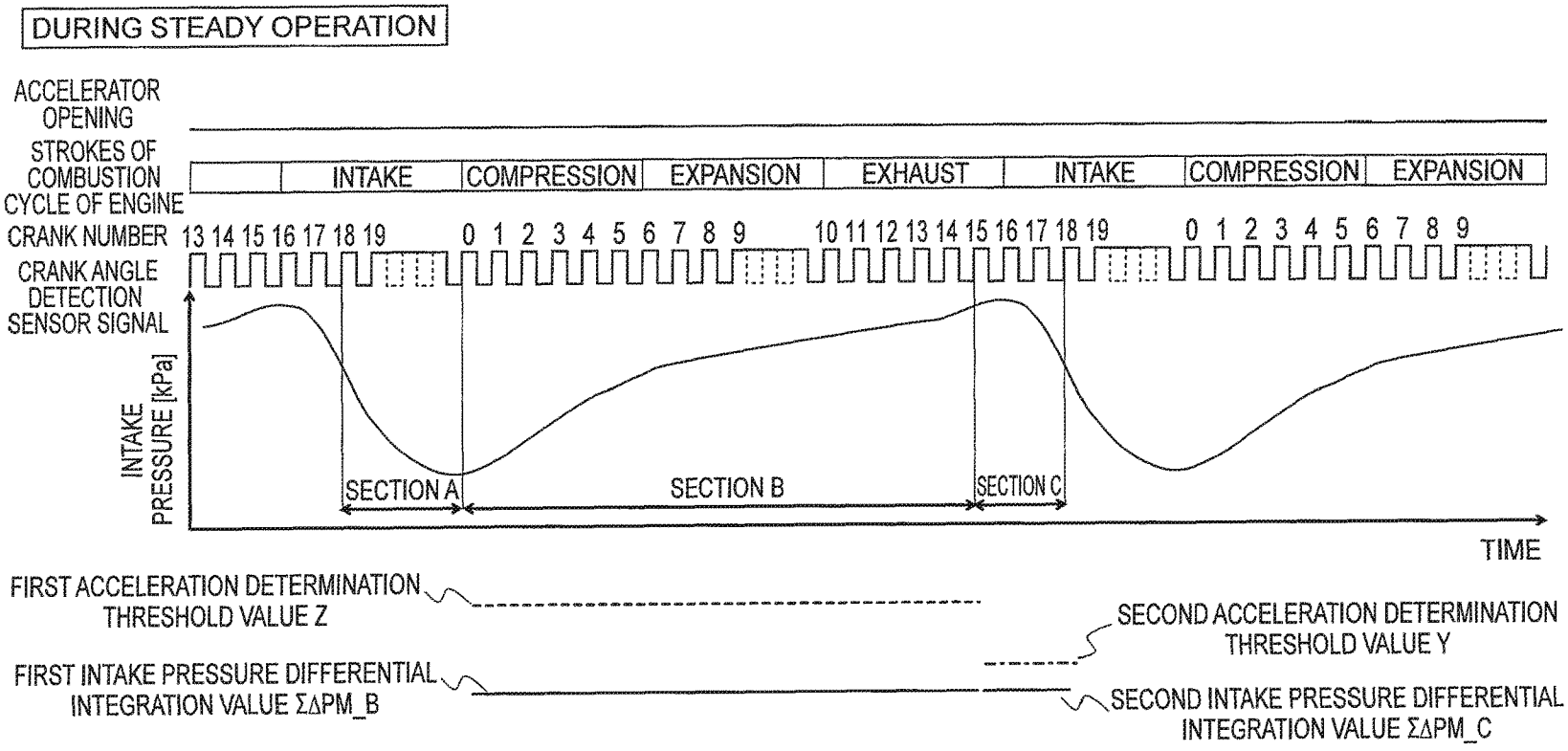
FIG. 3 is a timing chart showing change in the intake pressure during normal operation, in the engine control device according to the first embodiment of the invention.

Therefore, the normal fuel injection amount calculation unit 21 estimates the amount of air to be taken into the cylinder of the engine 19 in the next intake stroke, and thus determines the fuel injection amount, on the basis of the average value of the intake pressure, and the engine rotation speed Ne, during section A indicated in FIG. 3, for example.

FIG. 3 is a timing chart showing change in the intake pressure during normal operation, in the engine control device according to the first embodiment of the invention. As shown in FIG. 3, during steady operation when the accelerator opening does not change, the fuel injection amount which is calculated from the average intake pressure in section A and the engine rotation speed Ne, does not produce a transient shortfall with respect to the air intake amount in the next intake stroke.

Figure 4:
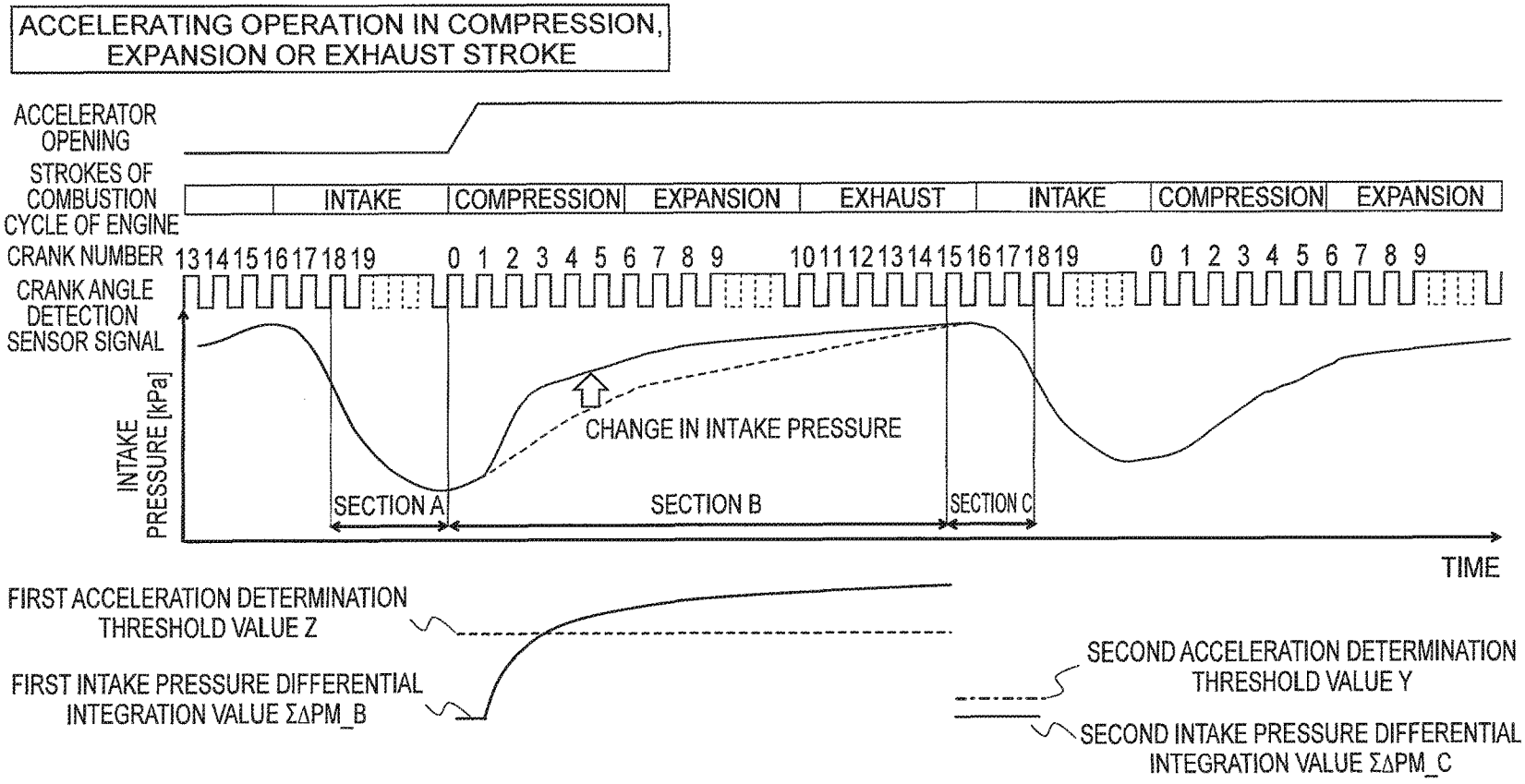
FIG. 4 is a timing chart showing change in the intake pressure during an accelerating operation, in a compression stroke, an expansion stroke or an exhaust stroke, in the engine control device according to the first embodiment of the invention.
Figure 5:
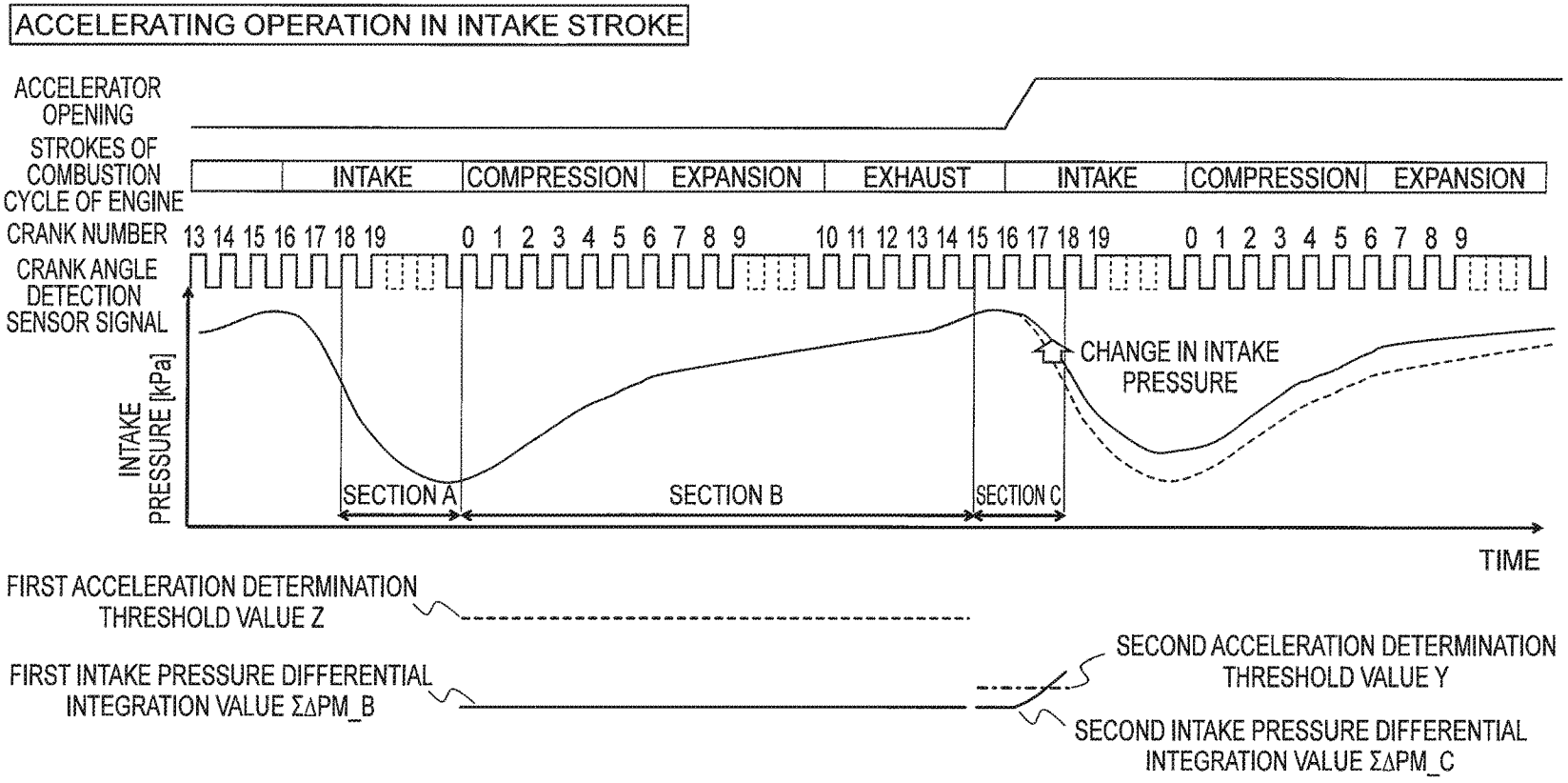
FIG. 5 is a timing chart showing change in the intake pressure during an accelerating operation in the intake stroke, in the engine control device according to the first embodiment of the invention.

However, if the accelerator opening changes and the intake air amount increases before the next intake stroke, as shown in FIG. 4 and FIG. 5, for example, then the resulting increase in the intake air amount cannot be predicted during section A. Therefore, in the fuel injection amount which is determined during section A, a shortfall in the fuel injection amount occurs with respect to the next intake air amount.

FIG. 4 is a timing chart showing change in the intake pressure during an accelerating operation, in a compression stroke, an expansion stroke or an exhaust stroke, in the engine control device according to the first embodiment of the invention. FIG. 5 is a timing chart showing change in the intake pressure during an accelerating operation in the intake stroke, in the engine control device according to the first embodiment of the invention.

Therefore, apart from the normal fuel injection amount calculation unit 21, a transience determination unit which determines that the accelerator opening has changed after section A, and a transient fuel injection amount calculation unit which calculates the fuel injection amount required in relation to the increased intake air amount are required. These elements are the first transience determination unit 22, the first transient fuel injection amount calculation unit 23, the second transience determination unit 24 and the second transient fuel injection amount calculation unit 25.

Here, the timing at which the intake pressure Pa is read in from the intake pressure sensor 5 is described with reference to FIG. 3. The combustion cycle of the engine has four cycles comprising an intake stroke, a compression stroke, an expansion stroke and an exhaust stroke, and the rotational speed of the crank shaft corresponding to one period of the four cycles is defined as a one-period crank angle. Therefore, the one-period crank angle is 720° crank angle (CA).

Furthermore, the angle obtained by dividing the one-period crank angle into a prescribed number of divisions is defined as a crank angle interval. In this first embodiment of the invention, the number of divisions is set to 24 and therefore each crank angle interval is 30° CA. Furthermore, the intake pressure Pa from the intake pressure sensor 5 is read out at each crank angle interval.

In actual practice, crank teeth are provided at each interval of 30° CA in an electric generator (not illustrated), and the control unit 1 detects the crank angle interval due to the crank teeth passing in front of the crank angle sensor 7. Furthermore, by providing a tooth-free section where no crank teeth are provided, in the generator, and comparing the period of the crank teeth, the control unit 1 detects the rotational period of the engine. In the first embodiment of the invention, the tooth-free section is equivalent to two teeth.

Moreover, since the intake pressure Pa changes significantly due to the negative pressure in the intake stroke, and the intake pressure Pa becomes close to atmospheric pressure in the expansion stroke, then the control unit 1 can detect the combustion cycle.

FIGS. 3, 4 and 5 show a state where the control unit 1 detects the combustion cycle of the engine 19 and numbers are set for the crank teeth. More specifically, a state is depicted in which a crank tooth in the compression stroke is set as number 0, and the numbers are allocated sequentially. A tooth-free section is provided between the crank number 9, in the expansion stroke and the crank number 10, in the expansion stroke, and between the crank number 19, in the intake stroke, and the crank number 0, in the compression stroke.

Furthermore, the intake pressure Pa detected at each crank angle interval of 30° CA is defined as PM, and the current intake pressure, of the intake pressures PM, is defined as $PM_n$. Furthermore, the intake pressure PM read in at one crank angle interval 30° CA prior to the intake pressure $PM_n$ is called $PM_{n-1}$. Furthermore, the intake pressure PM read in at a one-period crank angle interval 720° CA prior to the intake pressure $PM_n$ is called $PM_{nold}$.

In the first embodiment of the invention, the section from crank number 18 in the intake stroke to crank number 0 in the compression stroke is taken to be section A, and is a section in which a normal fuel injection amount is calculated. Furthermore, the section from the crank number 0 of the compression stroke to the crank number 15 of the exhaust stroke is taken to be section B and is a section in which the first transient fuel injection amount calculation unit 23 calculates an additional fuel injection amount. Furthermore, the section from the crank number 15 of the exhaust stroke to the crank number 18 of the intake stroke is taken to be section C and is a section in which the second transient fuel injection amount calculation unit 25 calculates an additional fuel injection amount.

The types of section are not limited to three, and the control accuracy of the air/fuel ratio of the engine may be further improved by further dividing the section in which the first transient fuel injection amount calculation unit 23 calculates the additional fuel injection amount, and making an acceleration determination based on the acceleration determination threshold value and calculating an additional fuel injection amount, respectively in each of the compression stroke, expansion stroke and exhaust stroke.

The first transience determination unit 22 detects change in the accelerator opening and determines acceleration in section B, which is a first section including the compression stroke, the expansion stroke and the exhaust stroke, that follows section A shown in FIG. 4, for example.

More specifically, the first transience determination unit 22 calculates a first intake pressure differential integration value by integrating the differential between the intake pressure $PM_n$ and the intake pressure $PM_{nold}$ for one period previously, at each crank angle interval in section B, and compares the first intake pressure differential integration value with a predetermined first acceleration determination threshold value Z. Furthermore, the first transience determination unit 22 determines an accelerating state of the engine 19 when the first intake pressure differential integration value is greater than the first acceleration determination threshold value Z, and outputs the first intake pressure differential integration value to the first transient fuel injection amount calculation unit 23.

Here, the integration value of the differential in the intake pressure PM is compared with the acceleration determination threshold value in order to avoid unnecessary additional fuel injection, since the injector, which is the fuel injection module 8, is not capable of performing very small fuel injections and there is a risk of enrichment of the air/fuel ratio by additional fuel injection. Therefore, the acceleration determination threshold value can be set on the basis of the relationship between the change in the intake pressure and the intake air amount which requires a fuel injection equal to or greater than the minimum fuel injection by the injector.

The first transient fuel injection amount calculation unit 23 calculates a first transient fuel injection amount for additional injection, on the basis of the first intake pressure differential integration value and the operational state information from the sensor group 15, when an accelerating state has been determined by the first transience determination unit 22.

The second transience determination unit 24 detects change in the accelerator opening and determines acceleration in section C, which is a second section including an intake stroke, that follows section B shown in FIG. 5, for example. More specifically, the second transience determination unit 24 calculates a second intake pressure differential integration value by integrating the differential between the intake pressure $PM_n$ and the intake pressure $PM_{nold}$ for one period previously, at each crank angle interval in section C, and compares the second intake pressure differential integration value with a predetermined second acceleration determination threshold value Y.

Furthermore, the second transience determination unit 24 determines an accelerating state of the engine 19 when the second intake pressure differential integration value is greater than the second acceleration determination threshold value Y, and outputs the second intake pressure differential integration value to the second transient fuel injection amount calculation unit 25.

The second transient fuel injection amount calculation unit 25 calculates a second transient fuel injection amount for additional injection, on the basis of the second intake pressure differential integration value and the operational state information from the sensor group 15, when an accelerating state has been determined by the second transience determination unit 24.

In FIG. 5, in section C in which an intake valve (not illustrated) of the engine 19 is opened and air is taken into the cylinder of the engine 19, a change in the intake pressure occurs. In this case, due to the delay in the response of the intake pressure sensor 5, it takes time for the change in the accelerator opening to affect the amount of change in the intake pressure, and therefore, it is necessary for the second transience determination unit 24 to determine the accelerating state on the basis of a very small change in the intake pressure, compared to the compression stroke, the expansion stroke or the exhaust stroke.

Furthermore, since it is necessary to inject the required fuel injection amount before the intake valve closes, then it is necessary to detect the change in the intake pressure quickly, and to predict the air intake amount that is to be taken in during the intake stroke and determine the required fuel injection amount. Therefore, the acceleration determination threshold value Y of the second transience determination unit 24 must be set to a smaller value than the acceleration determination threshold value Z of the first transience determination unit 22.

Furthermore, the second transient fuel injection amount is calculated on the basis of the second intake pressure differential integration value in section C, but must be set to a different value to the first transient fuel injection amount. This is in order to predict the increase in the intake air amount from the very slight change in the intake pressure and to determine the additional fuel injection amount that is required, in contrast to section B.

Figure 6:
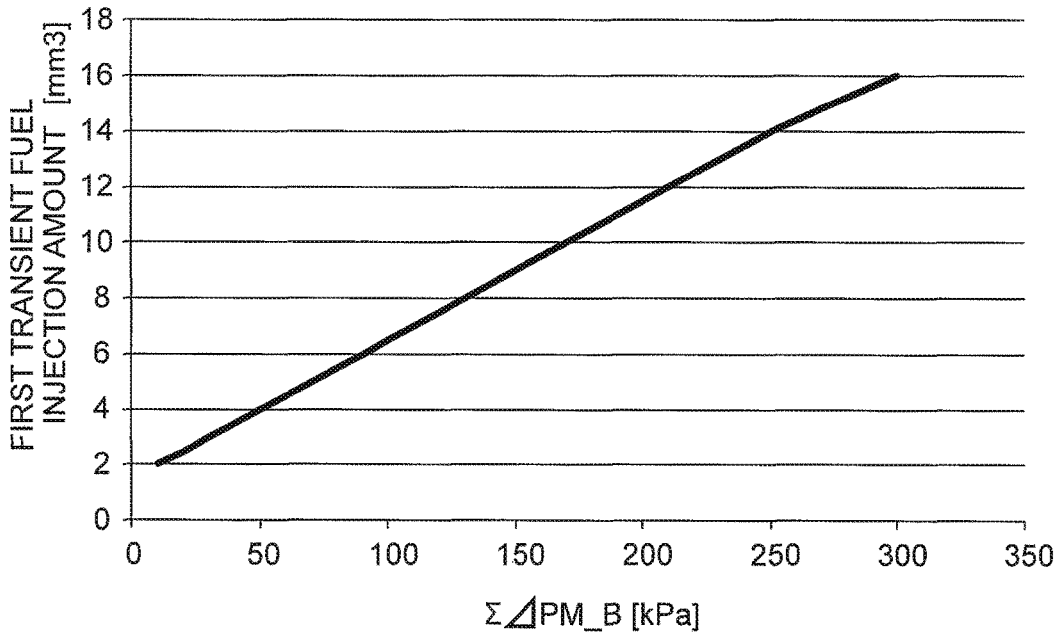
FIG. 6 is an illustrative diagram showing a relationship between a first intake pressure differential integration value and a first transient fuel injection amount in a first transient fuel injection amount calculation unit of the engine control device according to the first embodiment of the invention.
Figure 7:
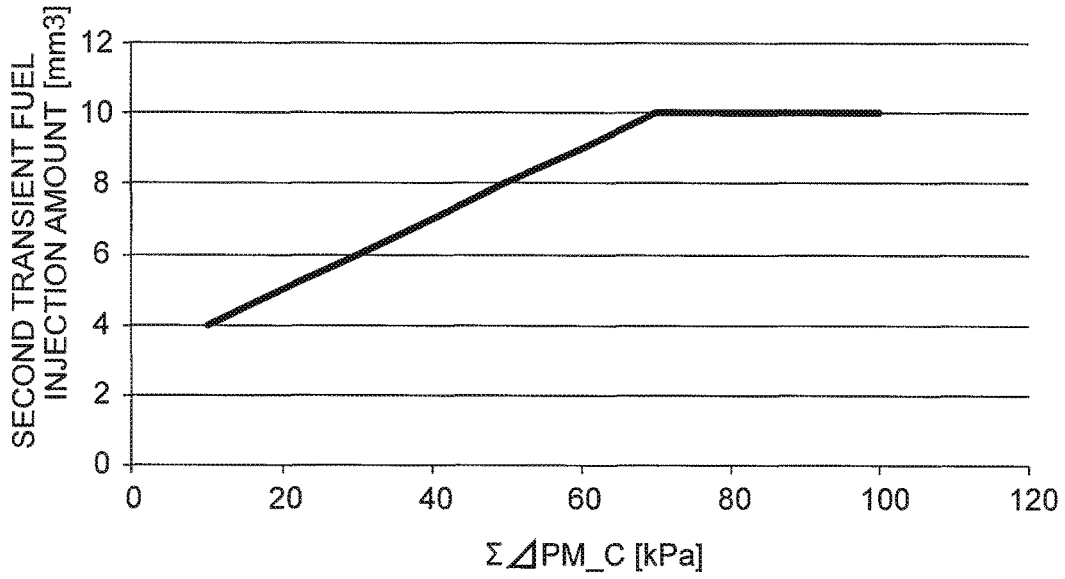
FIG. 7 is an illustrative diagram showing a relationship between a second intake pressure differential integration value and a second transient fuel injection amount in a second transient fuel injection amount calculation unit of the engine control device according to the first embodiment of the invention.

Here, FIG. 6 shows the relationship between the first intake pressure differential integration value and the first transient fuel injection amount in section B, and FIG. 7 shows the relationship between the second intake pressure differential integration value and the second transient fuel injection amount in section C. As can be seen from a comparison between FIG. 6 and FIG. 7, the second transient fuel injection amount is set to a larger additional fuel injection amount on the basis of a smaller intake pressure differential integration value, than the first transient fuel injection amount.

Furthermore, the fuel injection drive unit 26 drives the fuel injection module 8 on the basis of the fuel injection amount which is calculated by the normal fuel injection amount calculation unit 21, the first transient fuel injection amount calculation unit 23 or the second transient fuel injection amount calculation unit 25.

Figure 8:
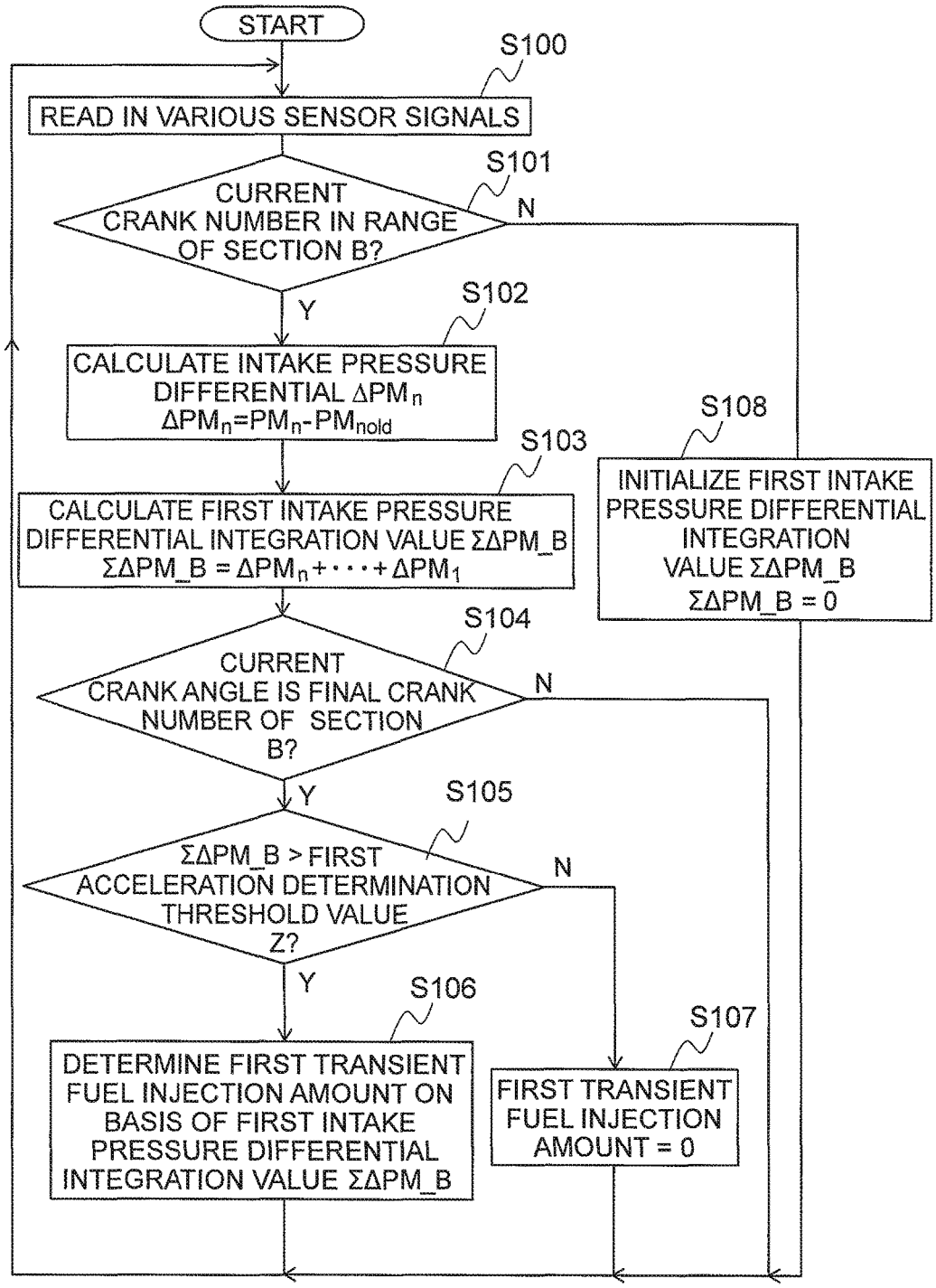
FIG. 8 is a flowchart showing the operation of a first transience determination unit and the first transient fuel injection amount calculation unit in the engine control device according to the first embodiment of the invention.

Below, the operation of the first transience determination unit 22 and the first transient fuel injection amount calculation unit 23 is described with reference to FIG. 8. FIG. 8 is a flowchart showing the operation of the first transience determination unit and the first transient fuel injection amount calculation unit in the engine control device according to the first embodiment of the invention.

In FIG. 8, firstly, the first transience determination unit 22 reads in various sensor signals (step S100). In other words, the first transience determination unit 22 reads in operational state information from the intake pressure sensor 5 and the sensor group 15, which indicates the operational state of the engine 19. Here, the sensor group 15 includes the intake air temperature sensor 2, the engine temperature sensor 6, the crank angle sensor 7 and the oxygen sensor 11, but the operational state information does not have to include operational state information from all of these sensors.

Next, the first transience determination unit 22 refers to the crank number and determines whether or not the current crank number is within the range of section B (step S101). In this first embodiment, the crank number is determined to be within the range of section B, if the crank number is between 0 and 14 inclusive.

In step S101, if it is determined that the current crank number is in the range of section B (in other words, Yes), then the first transience determination unit 22 calculates the differential $\Delta PM_n$ between the intake pressure $PM_n$ and the intake pressure for one period previously, $PM_{nold}$(step S102).

Next, the first transience determination unit 22 calculates the integration value ΣΔPM_B of the differential $\Delta PM_n$ calculated in step S102 for section B (step S103). In this case, as shown in FIG. 4, if the accelerator opening has changed in the compression stroke, then the intake pressure in section B changes, and the first intake pressure differential integration value, ΣΔPM_B, progressively increases.

Subsequently, the first transience determination unit 22 refers to the crank number and determines whether or not the current crank number is the final crank number in section B (step S104). In this first embodiment of the invention, the crank number 14 in the exhaust stroke is the final crank number in section B.

In step S104, if it is determined that the current crank number is the final crank number of section B (in other words, Yes), then the first transience determination unit 22 determines whether or not the first intake pressure differential integration value ΣΔPM_B is greater than the first acceleration determination threshold value Z (step S105).

In step S105, if it is determined that the first intake pressure differential integration value ΣΔPM_B is greater than the first acceleration determination threshold value Z (in other words, Yes), then the engine is determined to be in an accelerating state.

In this case, the first transient fuel injection amount calculation unit 23 determines that the accelerator opening has increased in section B, the amount of air taken into the cylinder of the engine 19 has risen and the normal fuel injection amount determined during section A is insufficient, and therefore calculates a first transient fuel injection amount, which is an additional fuel injection amount (step S106).

The first transient fuel injection amount is determined on the basis of the first intake pressure differential integration value ΣΔPM_B and the operational state information from the sensor group 15. For example, the relationship between the first intake pressure differential integration value ΣΔPM_B and the first transient fuel injection amount is such that, as shown in FIG. 6, the amount of air taken in the next intake stroke becomes greater when the first intake pressure differential integration value ΣΔPM_B is large. Consequently, the first transient fuel injection amount rises in direct proportion to the first intake pressure differential integration value ΣΔPM_B.

Moreover, the first transient fuel injection amount is corrected on the basis of the operational state information from the sensor group 15, thereby determining the final first transient fuel injection amount. Furthermore, a fuel injection corresponding to the first transient fuel injection amount is performed from the fuel injection module 8, at the final crank number of section B, in other words, at crank number 14 in the exhaust stroke. Below, the fuel injection corresponding to the first transient fuel injection amount is called first transient fuel injection.

On the other hand, in step S105, if it is determined that the first intake pressure differential integration value ΣΔPM_B is equal to or lower than the first acceleration determination threshold value Z (in other words, No), then it is determined that the engine is not in an accelerating state.

In this case, the first transient fuel injection amount calculation unit 23 determines that there is no change in the intake pressure sufficient to determine an accelerating state, or that there is no change in the air amount sufficient to effect the air-fuel ratio, or that only a fuel injection amount smaller than the minimum fuel injection amount of the injector, which is the fuel injection module 8, is required, and therefore sets the first transient fuel injection amount in section B, in other words, the additional fuel injection amount, to zero (step S107), and returns to step S100 and repeats the routine in FIG. 8.

Furthermore, in step S104, if it is determined that the current crank number is not the final crank number of section B (in other words, No), then the procedure returns to step S100 and the routine in FIG. 8 is repeated until the crank number reaches the final crank number in section B.

Furthermore, at step S101, if it is determined that the current crank number is not in the range of section B (in other words, No), then the first transience determination unit 22 initializes the first intake pressure differential integration value ΣΔPM_B (step S108), returns to step S100, and repeats the routine in FIG. 8.

Figure 9:
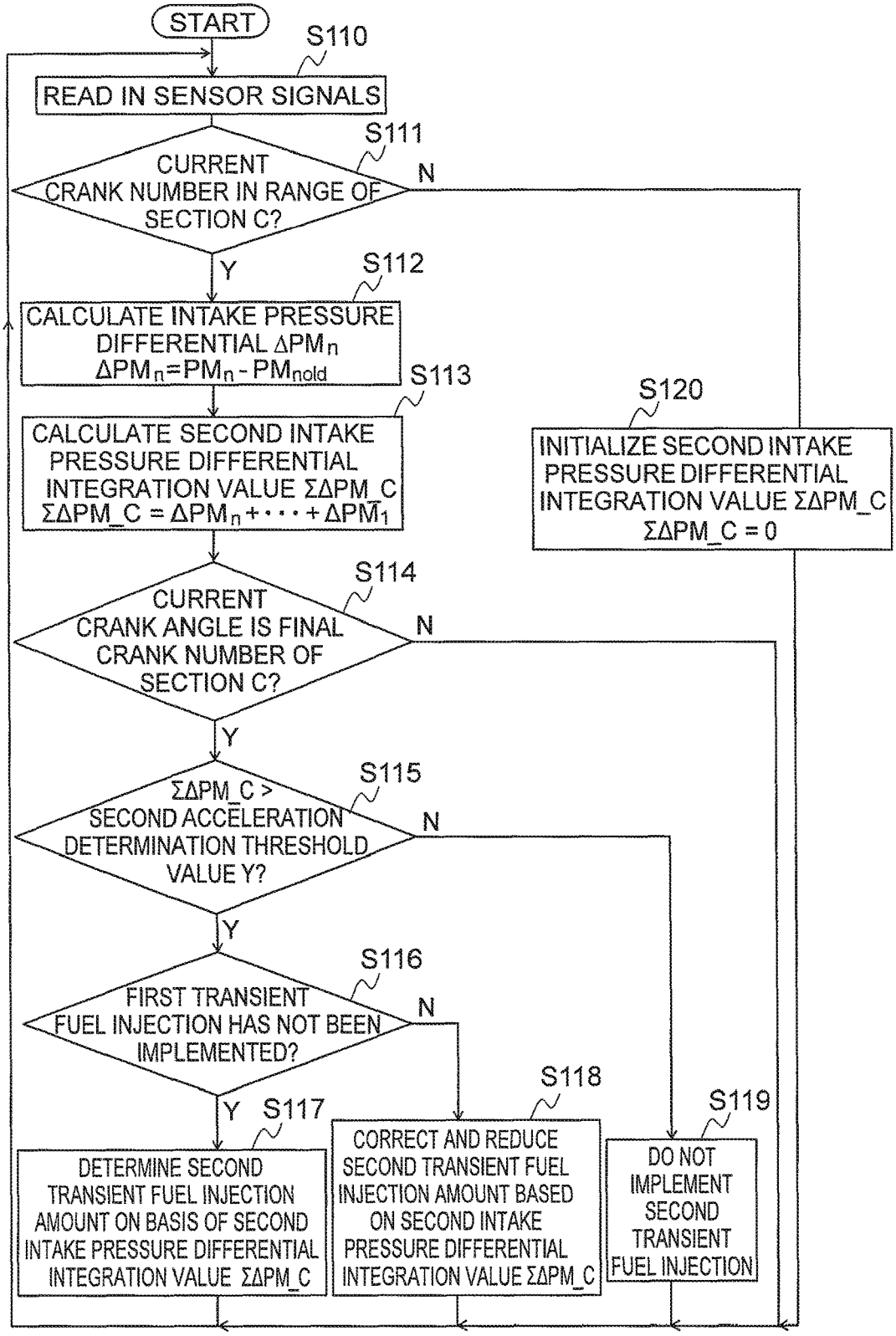
FIG. 9 is a flowchart showing the operation of a second transience determination unit and the second transient fuel injection amount calculation unit in the engine control device according to the first embodiment of the invention.

Below, the operation of the second transience determination unit 24 and the second transient fuel injection amount calculation unit 25 is described with reference to FIG. 9. FIG. 9 is a flowchart showing the operation of the second transience determination unit and the second transient fuel injection amount calculation unit in the engine control device according to the first embodiment of the invention.

In FIG. 9, firstly, the second transience determination unit 24 reads in various sensor signals (step S110). In other words, the second transience determination unit 24 reads in operational state information from the intake pressure sensor 5 and the sensor group 15, which indicates the operational state of the engine 19. Here, the sensor group 15 includes the intake air temperature sensor 2, the engine temperature sensor 6, the crank angle sensor 7 and the oxygen sensor 11, but the operational state information does not have to include operational state information from all of these sensors.

Next, the second transience determination unit 24 refers to the crank number and determines whether or not the current crank number is within the range of section C (step S111). In this first embodiment, the crank number is determined to be within the range of section C, if the crank number is between 15 and 17 inclusive.

In step S111, if it is determined that the current crank number is in the range of section C (in other words, Yes), then the second transience determination unit 24 calculates the differential $\Delta PM_n$ between the intake pressure PM, and the intake pressure for one period previously, $PM_{nold}$(step S112).

Next, the second transience determination unit 24 calculates the integration value ΣΔPM_C of the differential $\Delta PM_n$ calculated in step S112 for section C (step S113). In this case, as shown in FIG. 5, if the accelerator opening has changed in the intake stroke, then the intake pressure in section C changes, and the second intake pressure differential integration value, ΣΔPM_C, progressively increases.

Subsequently, the second transience determination unit 24 refers to the crank number and determines whether or not the current crank number is the final crank number in section C (step S114). In this first embodiment of the invention, the crank number 17 in the intake stroke is the final crank number in section C.

In step S114, if it is determined that the current crank number is the final crank number of section C (in other words, Yes), then the second transience determination unit 24 determines whether or not the second intake pressure differential integration value ΣΔPM_C is greater than the second acceleration determination threshold value Y (step S115).

In step S115, if it is determined that the second intake pressure differential integration value ΣΔPM_C is greater than the second acceleration determination threshold value Y (in other words, Yes), then the engine is determined to be in an accelerating state.

In this case, the second transient fuel injection amount calculation unit 25 determines an accelerating state by the first transience determination unit 22, and determines whether or not the first transient fuel injection has been implemented (step S116). Here, an accelerating state is determined by the first transience determination unit 22 when the accelerator opening has changed in section B and a first transient fuel injection has been carried out in response to the additional fuel injection amount corresponding to this change. In other words, this is a state where a necessary additional fuel injection has already been implemented.

In step S116, if it is determined that the first transient fuel injection has not been implemented (in other words, Yes), then the second transient fuel injection amount calculation unit 25 determines that the accelerator opening has increased in section C, the amount of air taken into the cylinder of the engine 19 has risen and the normal fuel injection amount determined during section A is insufficient, and therefore calculates a second transient fuel injection amount, which is an additional fuel injection amount (step S117).

The second transient fuel injection amount is determined on the basis of the second intake pressure differential integration value ΣΔPM_C and the operational state information from the sensor group 15. For example, the relationship between the second intake pressure differential integration value ΣΔPM_C and the second transient fuel injection amount is such that, as shown in FIG. 7, the amount of air taken in the next intake stroke becomes greater when the second intake pressure differential integration value ΣΔPM_C is large. Consequently, the second transient fuel injection amount rises in direct proportion to the second intake pressure differential integration value ΣΔPM_C.

However, since the time during which additional fuel injection is possible in the intake stroke is limited, then an upper limit is provided on the basis of the characteristics of the injector, which is the fuel injection module 8. Moreover, the second transient fuel injection amount is corrected on the basis of the operational state information from the sensor group 15, thereby determining the final second transient fuel injection amount.

Furthermore, a fuel injection corresponding to the second transient fuel injection amount is performed from the fuel injection module 8, at the final crank number of section C, in other words, at crank number 17 in the exhaust stroke. Below, the fuel injection corresponding to the second transient fuel injection amount is called second transient fuel injection.

On the other hand, in step S116, if it is determined that the first transient fuel injection has been implemented (in other words, No), then the second transient fuel injection amount calculation unit 25 reduces the second transient fuel injection amount from the value calculated on the basis of the second intake pressure differential integration value ΣΔPM_C, in order to suppress enrichment of the air/fuel ratio of the engine, because the first transient fuel injection has already been implemented (step S118). Here, the method of reduction is determined in accordance with the first transient fuel injection amount, and if excessive enrichment is predicted, than the second transient fuel injection amount may be set to zero.

This is because if the accelerator opening has changed in section B, and the intake pressure also happens to change in section C, but the second transient fuel injection has been implemented at that point, then the fuel injection amount will become excessively large with respect to the amount of air taken into the cylinder of the engine 19 and there is a possibility of producing excessive enrichment of the air/fuel ratio. Therefore, if an accelerating state is determined by the first transience determination unit 22 and the first transient fuel injection has been implemented, then the second transient fuel injection amount is reduced.

On the other hand, in step S115, if it is determined that the second intake pressure differential integration value ΣΔPM_C is equal to or lower than the second acceleration determination threshold value Y (in other words, No), then it is determined that the engine is not in an accelerating state.

In this case, the second transient fuel injection amount calculation unit 25 determines that there is no change in the intake pressure sufficient to determine an accelerating state, or that there is no change in the air amount sufficient to affect the air-fuel ratio, or that only a fuel injection amount smaller than the minimum fuel injection amount of the injector, which is the fuel injection module 8, is required, and therefore sets the additional fuel injection in section C as unnecessary (step S119), and returns to step S110 and repeats the routine in FIG. 9.

Furthermore, in step S114, if it is determined that the current crank number is not the final crank number of section C (in other words, No), then the procedure returns to step S110 and the routine in FIG. 9 is repeated until the crank number reaches the final crank number in section C.

Furthermore, at step S111, if it is determined that the current crank number is not in the range of section C (in other words, No), then the second transience determination unit 24 initializes the second intake pressure differential integration value ΣΔPM_C (step S120), returns to step S110, and repeats the routine in FIG. 9.

As described above, according to the first embodiment, there are provided: a throttle valve provided in an intake pipe of an engine; an intake pressure sensor which detects an intake pressure inside the intake pipe on a downstream side of the throttle valve; a crank angle sensor which detects a crank angle of a crankshaft of the engine; and a fuel injection control unit which controls an amount of fuel injected to a cylinder of the engine, on the basis of the intake pressure detected by the intake pressure sensor, wherein the fuel injection control unit includes: a first transience determination unit which calculates, as a first intake pressure differential integration value, an integrated value of an amount of change in the intake pressure in a first section that includes a compression stroke, an expansion stroke and an exhaust stroke, of a combustion cycle of the engine, and which determines an accelerating state of the engine when the first intake pressure differential integration value is greater than a first acceleration determination threshold value; a first transient fuel injection amount calculation unit which calculates an additional fuel injection amount on the basis of the first intake pressure differential integration value; a second transience determination unit which calculates, as a second intake pressure differential integration value, an integrated value of an amount of change in the intake pressure in a second section that includes an intake stroke, of the combustion cycle of the engine, and which determines an accelerating state of the engine when the second intake pressure differential integration value is greater than a second acceleration determination threshold value which is smaller than the first acceleration determination threshold value; and a second transient fuel injection amount calculation unit which calculates an additional fuel injection amount on the basis of the second intake pressure differential integration value.

Consequently, the combustion cycle of the engine is divided into sections, namely, a section including the compression stroke, the expansion stroke and the exhaust stroke in which change in the intake pressure with respect to change in the accelerator opening is sufficiently apparent and there is a time margin for implementing additional fuel injection, and a section including the intake stroke in which it is necessary to determine acceleration and implement additional fuel injection before change in the intake pressure is sufficiently apparent with respect to change in the accelerator opening, and acceleration is determined in each of the sections respectively, and if there is a change in the accelerator opening, it is possible to determine a suitable additional fuel injection amount for each section, in accordance with the increasing amount of intake air.

Therefore, if the accelerator opening has increased in the compression stroke, the expansion stroke or the exhaust stroke, the determination of acceleration and specification of the additional fuel injection amount can be carried out on the basis of the amount of change in the intake pressure, and even when the accelerator opening is increased in the intake stroke, acceleration is determined by identifying a small amount of change in the intake pressure, the increase in the amount of intake air is predicted on the basis of the small amount of change in the intake pressure, and an additional fuel injection amount can be determined.

Furthermore, by providing acceleration determination threshold values which are suitable for respective sections, in view of the fact that the liability of the intake pressure differential integration value to change varies between the respective sections of the first transience determination unit and the second transience determination unit, and by also making the second acceleration determination threshold value smaller than the first acceleration determination threshold value, the second transience determination unit is able to determine acceleration even though the section is shorter than that of the first transience determination unit, and change in the intake pressure is less readily apparent in relation to change in the throttle opening.

Consequently, it is possible to control the air/fuel ratio with high accuracy, even when the accelerator opening changes at any timing during the combustion cycle of the engine.

Furthermore, in the first section, the first transience determination unit calculates the first intake pressure differential integration value by integrating, in the first section, the differential between the current intake pressure and the intake pressure for one period previously, and in the second section, the second transience determination unit calculates the second intake pressure differential integration value by integrating, in the second section, the differential between the current intake pressure and the intake pressure for one period previously.

Consequently, in each of the sections, it is possible to ascertain, reliably, the amount of change in the intake pressure in the current combustion cycle, from one period previously in the combustion cycle of the engine.

Furthermore, the second transient fuel injection amount calculation unit is capable of determining a larger additional fuel injection amount than the first transient fuel injection amount calculation unit, in relation to the same intake pressure differential integration value as the intake pressure differential integration value calculated by the first transient fuel injection amount calculation unit.

The first transient fuel injection amount calculation unit calculates an additional fuel injection amount in respect of the intake air amount which is predicted to increase in the next intake stroke, on the basis of the actual amount of change in the intake pressure detected in the compression stroke, the expansion stroke or the exhaust stroke, and the second transient fuel injection amount calculation unit must calculate an additional fuel injection amount, by predicting the intake air amount which increases in the intake stroke, from the small amount of change in the intake pressure detected in the intake stroke.

Therefore, the first transient fuel injection amount calculation unit and the second transient fuel injection amount calculation unit are characterized in having different gains in the additional fuel injection amount with respect to the intake pressure differential integration value, and the second transient fuel injection amount calculation unit is able to predict the increase in the intake air amount from a small change in the intake pressure, by setting the additional fuel injection amount to a large amount in relation to the same intake pressure differential integration value as the intake pressure differential integration value calculated by the first transient fuel injection amount calculation unit.

Furthermore, the second transient fuel injection amount calculation unit reduces the additional fuel injection amount in a case where the accelerating state of the engine is determined by the first transience determination unit, compared to a case where the accelerating state of the engine is not determined by the first transience determination unit.

Here, if the accelerator opening has increased between the compression stroke and the exhaust stroke, for example, then a change occurs in the intake pressure during this section, and it is possible to determine the acceleration and implement an additional fuel injection by the first transience determination unit, but since the intake pressure may also happen to change during the intake stroke, then there is a possibility of the second transience determination unit also determining acceleration.

In this case, if the additional fuel injection amount is calculated by the second transient fuel injection amount calculation unit without taking account of the first addition fuel injection, and a second additional fuel injection is implemented, then the fuel injection amount becomes excessively large and the air/fuel ratio of the engine becomes excessively rich.

On the other hand, if the additional fuel injection amount is reduced by the second transient fuel injection amount calculation unit, then it is possible to prevent excessive enrichment of the air/fuel ratio.

What is claimed is:

1. An engine control device, comprising:

a throttle valve provided in an intake pipe of an engine;

an intake pressure sensor which detects an intake pressure inside the intake pipe on a downstream side of the throttle valve;

a crank angle sensor which detects a crank angle of a crankshaft of the engine; and a microcomputer comprising a fuel injection control unit which controls an amount of fuel injected to a cylinder of the engine, based on the intake pressure detected by the intake pressure sensor, wherein the fuel injection control unit includes:

a first transience determination unit which calculates, as a first intake pressure differential integration value, an integrated value of an amount of change in the intake pressure in a first section that consists of a compression stroke, an expansion stroke and a former part of an exhaust stroke, of a combustion cycle of the engine, and which determines an accelerating state of the engine when the first intake pressure differential integration value is greater than a first acceleration determination threshold value;

a first transient fuel injection amount calculation unit which calculates a first transient fuel injection amount based on the first intake pressure differential integration value;

a second transience determination unit which calculates, as a second intake pressure differential integration value, an integrated value of an amount of change in the intake pressure in a second section that consists of a latter part of the exhaust stroke and an intake stroke subsequent to the exhaust stroke, of the combustion cycle of the engine, and which determines an accelerating state of the engine when the second intake pressure differential integration value is greater than a second acceleration determination threshold value which is smaller than the first acceleration determination threshold value; and a second transient fuel injection amount calculation unit which calculates a second transient fuel injection amount based on the second intake pressure differential integration value.

2. The engine control device according to claim 1, wherein, in the first section, the first transience determination unit calculates the first intake pressure differential integration value by integrating, in the first section, a differential between a current intake pressure and an intake pressure for one period previously; and in the second section, the second transience determination unit calculates the second intake pressure differential integration value by integrating, in the second section, a differential between a current intake pressure and an intake pressure for one period previously.

3. The engine control device according to claim 1, wherein the second transient fuel injection amount calculation unit is capable of determining the second transient fuel injection amount which is larger than the first transient fuel injection amount determined by the first transient fuel injection amount calculation unit, in relation to the same intake pressure differential integration value as the intake pressure differential integration value calculated by the first transient fuel injection amount calculation unit.

4. The engine control device according to claim 2, wherein the second transient fuel injection amount calculation unit is capable of determining the second transient fuel injection amount which is larger than the first transient fuel injection amount determined by the first transient fuel injection amount calculation unit, in relation to the same intake pressure differential integration value as the intake pressure differential integration value calculated by the first transient fuel injection amount calculation unit.

5. The engine control device according to claim 1, wherein the second transient fuel injection amount calculation unit reduces the second transient fuel injection amount in a case where the accelerating state of the engine is determined by the first transience determination unit, compared to a case where the accelerating state of the engine is not determined by the first transience determination unit.

6. The engine control device according to claim 2, wherein the second transient fuel injection amount calculation unit reduces the second transient fuel injection amount in a case where the accelerating state of the engine is determined by the first transience determination unit, compared to a case where the accelerating state of the engine is not determined by the first transience determination unit.

7. The engine control device according to claim 3, wherein the second transient fuel injection amount calculation unit reduces the second transient fuel injection amount in a case where the accelerating state of the engine is determined by the first transience determination unit, compared to a case where the accelerating state of the engine is not determined by the first transience determination unit.

8. The engine control device according to claim 4, wherein the second transient fuel injection amount calculation unit reduces the second transient fuel injection amount in a case where the accelerating state of the engine is determined by the first transience determination unit, compared to a case where the accelerating state of the engine is not determined by the first transience determination unit.

9. An engine control method performed in an engine control device that includes:

a throttle valve provided in an intake pipe of an engine;

an intake pressure sensor which detects an intake pressure inside the intake pipe on a downstream side of the throttle valve;

a crank angle sensor which detects a crank angle of a crankshaft of the engine; and a fuel injection control unit which controls an amount of fuel injected to a cylinder of the engine, based on the intake pressure detected by the intake pressure sensor, the method comprising:

a first transience determination step of calculating, as a first intake pressure differential integration value, an integrated value of an amount of change in the intake pressure in a first section that consists of a compression stroke, an expansion stroke and a former part of an exhaust stroke, of a combustion cycle of the engine, and determining an accelerating state of the engine when the first intake pressure differential integration value is greater than a first acceleration determination threshold value;

a first transient fuel injection amount calculation step of calculating a first transient fuel injection amount based on the first intake pressure differential integration value;

a second transience determination step of calculating, as a second intake pressure differential integration value, an integrated value of an amount of change in the intake pressure in a second section that consists of a latter part of the exhaust stroke and an intake stroke, of the combustion cycle of the engine, and determining an accelerating state of the engine when the second intake pressure differential integration value is greater than a second acceleration determination threshold value which is smaller than the first acceleration determination threshold value; and a second transient fuel injection amount calculation step of calculating a second transient fuel injection amount based on the second intake pressure differential integration value.

* * * * *